United States Patent [19]

Alper

[11] 4,209,139

[45] Jun. 24, 1980

[54] POWER DRIVEN PAPER TAKE-UP MECHANISM

[75] Inventor: Daniel D. Alper, Ypsilanti, Mich.

[73] Assignee: Burroughs Corporation, Detroit, Mich.

[21] Appl. No.: 16,389

[22] Filed: Mar. 1, 1979

[51] Int. Cl.[2] ..... B65H 17/02

[52] U.S. Cl. ..... 242/67.3 R

[58] Field of Search ..... 242/67.1 R, 67.2, 67.3 R, 242/65

[56] References Cited

U.S. PATENT DOCUMENTS

| | | | |
|---|---|---|---|
| 1,925,580 | 9/1933 | Anderson | 242/67.3 R |
| 3,279,718 | 10/1968 | Arterton | 242/67.1 R |
| 3,792,820 | 2/1974 | Lucas | 242/67.3 R |
| 4,003,527 | 1/1977 | Schulze | 242/67.3 R |

*Primary Examiner*—Edward J. McCarthy

*Attorney, Agent, or Firm*—Kenneth J. Cooper; Charles P. Sammut; Charles E. Ouarton

[57] ABSTRACT

A power driven paper take-up mechanism utilizes a single slip drive system and one or more paper rewind coils in an arrangement which allows the single slip drive system to simultaneously apply the appropriate forward driving force to one or more paper rolls.

6 Claims, 5 Drawing Figures

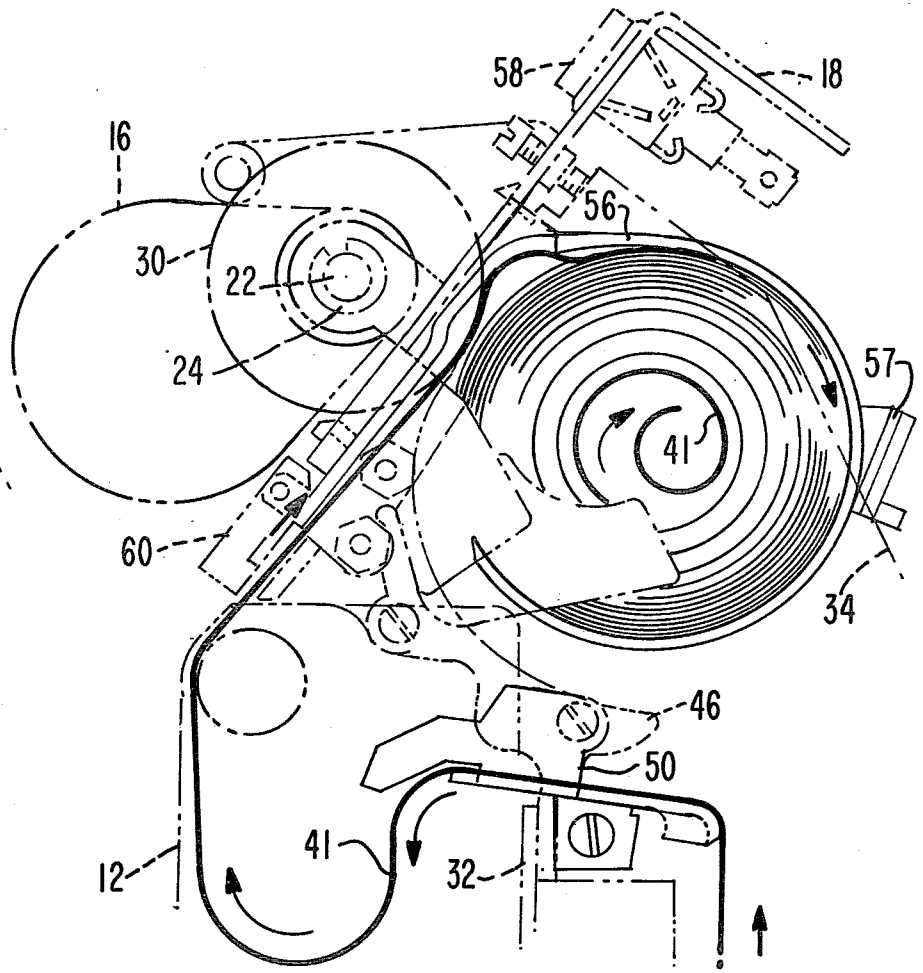
FIG. 4.
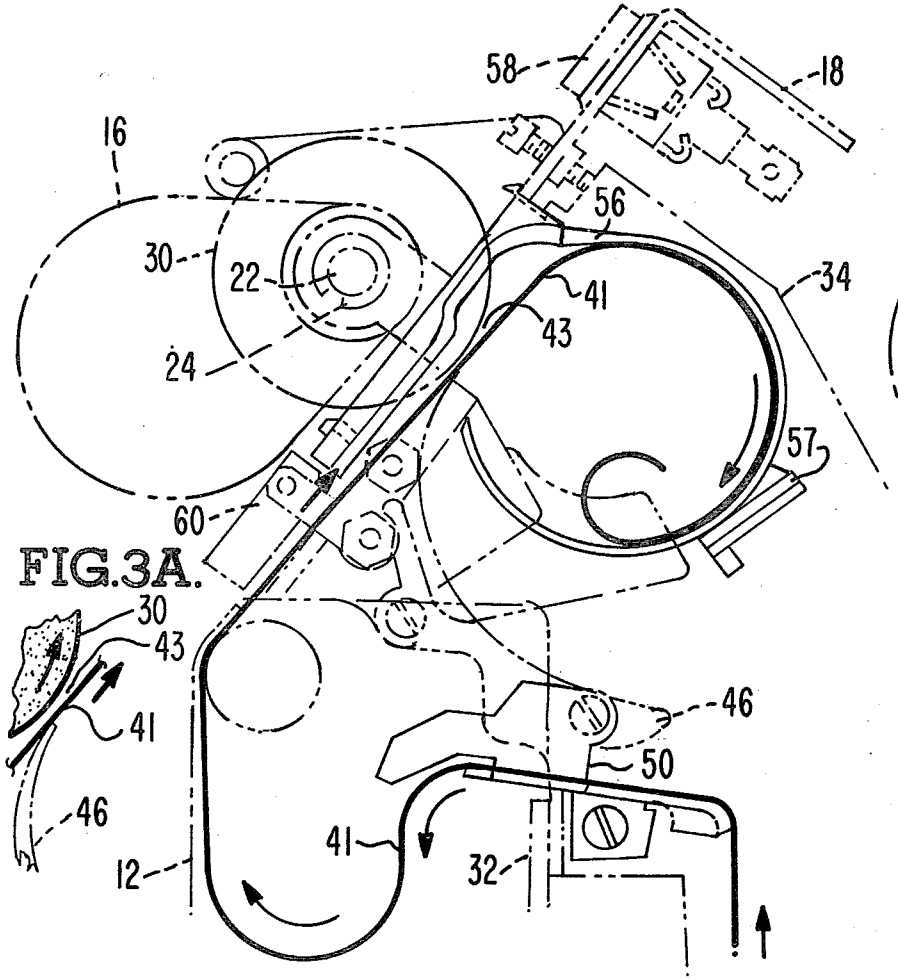
FIG. 3.
FIG. 3A.

POWER DRIVEN PAPER TAKE-UP MECHANISM

BACKGROUND OF THE INVENTION

1. Field of the Invention

This invention relates generally to a power driven paper take-up mechanism and in particular to a mechanism which allows a single slip drive system to simultaneously provide the appropriate driving force to one or more separate paper rolls.

2. Description of the Prior Art

There are basically two types of power-driven paper take-up devices. The first type is a positive drive system which drives a section of a paper roll intermittently, starting when there is paper to take up and stopping once the slack is eliminated. This type of system, of necessity, requires either a sensor that determines when slack exists in the section of paper between the printing elements and the take up area, or that the system be sychronized with the printing mechanism. The second type of take-up device is a slip drive system. A slip drive system utilizes either a limited friction device, such as a roller, which rotates in a direction such that the contact between the roller and paper takes up the slack in the paper, or a slip device between a drive motor and a non-slipping roller.

Each of these systems, however, is not easily adapted for use especially on a multiple roll printer. One disadvantage of the intermittent type system is that a separate system is required for each roll of paper of a multiple paper roll printer.

If a single slip type system is used for multiple paper rolls, those paper rolls adjacent to a roll being spaced by the printer mechanism may also be advanced, thereby causing blank spaces between lines and severely reducing paper economy. Accordingly, it is desireable to provide a single system that will simultaneously provide the proper driving force to multiple paper rolls without producing blank spaces between successive print lines in each roll.

SUMMARY OF THE INVENTION

The object of the invention is to provide a mechanism which utilizes single slip drive system to simultaneously apply the appropriate driving force to one or more paper rolls. A feed roller applies to each paper roll a driving force which is proportional to the resistance or backpressure from the paper entering each paper rewind coil. Thus, each paper roll is advanced with sufficient force to take up any slack in the paper roll, but yet without pulling paper from the printer thereby wasting paper.

The mechanism utilizes a paper rewind coil for each roll of paper. Each paper rewind coil is positioned adjacent to a feed roller such that at the start of the print-out the paper encounters no resistance. Thus, the feed roller produces no forward driving force on the paper. As the paper fills the paper rewind coil, the paper rewind coil positions the paper against the drive roller such that the proper forward driving force is applied. In essence, the feed roller functions as a mechanical check valve. Furthermore, the drive roller and paper rewind coil are configured and the friction of the drive roller is such that the forward driving force applied to the paper never exceeds the back pressure from the paper, thereby insuring that the paper is not pulled from the printer thus causing blank spaces and paper waste.

BRIEF DESCRIPTION OF THE DRAWING

FIG. 3 is a detailed side view of the preferred embodiment of the invention which illustrates the condition where the feed roller provides essentially no forward driving force to the paper.

FIG. 3A is an exploded view of a section of FIG. 3 detailing the gap between the feed roller and the paper.

FIG. 4 is a detailed side view of the preferred embodiment of the invention which illustrates the condition where the feed roller provides a forward driving force to the paper.

DETAILED DESCRIPTION OF THE PREFERRED EMBODIMENT OF THE INVENTION

Figure 1:
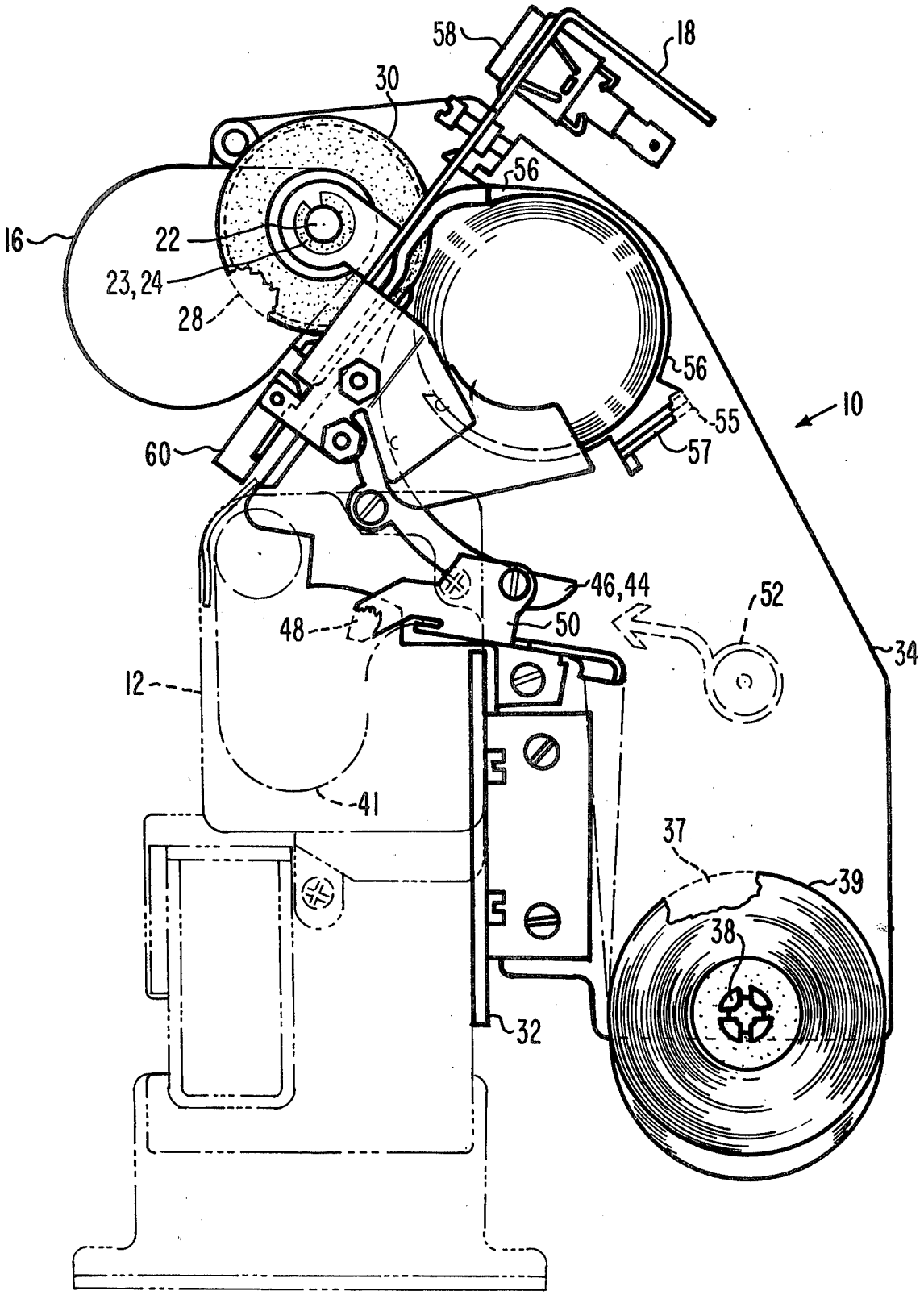
FIG. 1 is a side view of a preferred embodiment of the invention.
Figure 2:
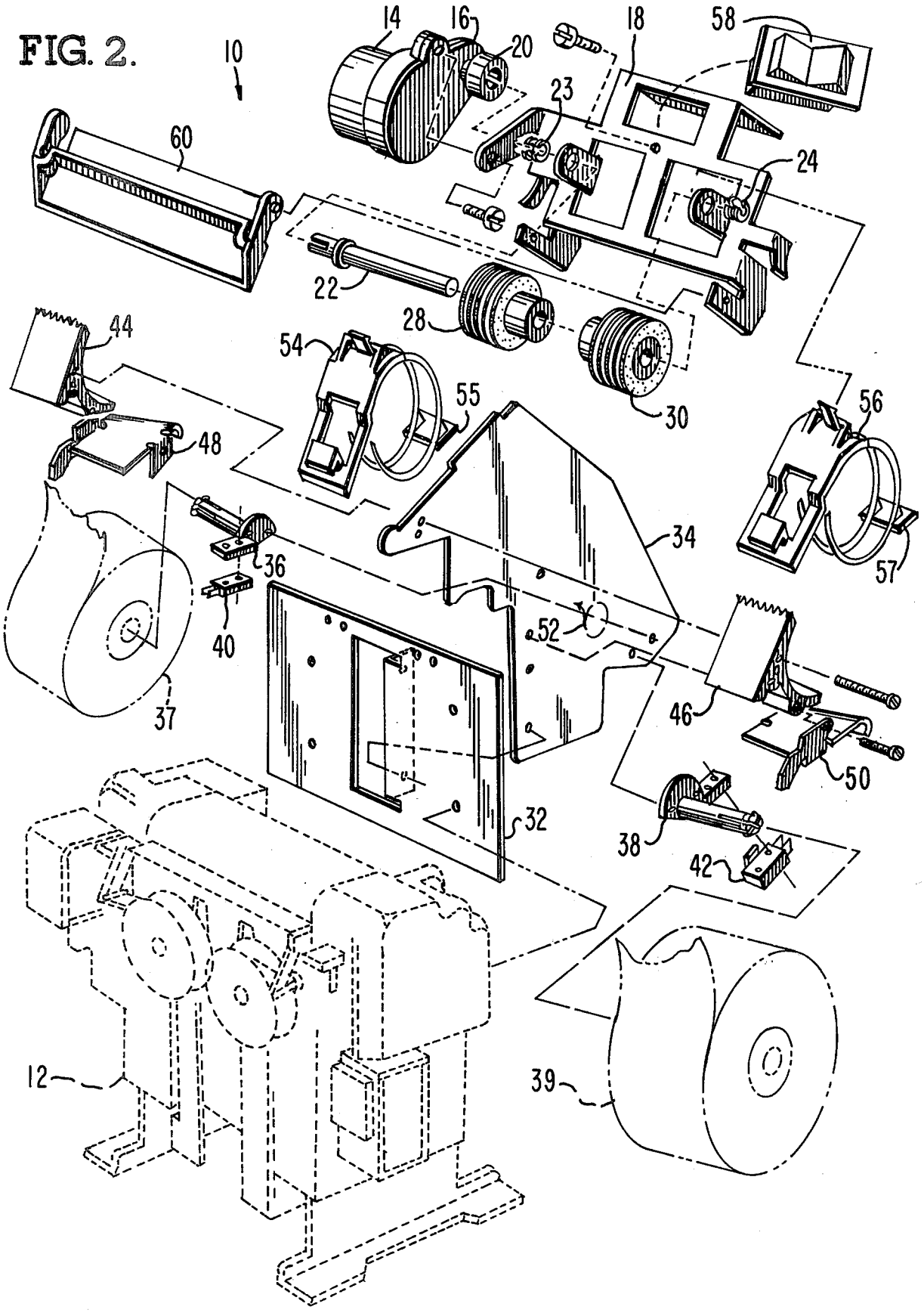
FIG. 2 is an exploded view of a preferred embodiment of the invention.

Referring to the drawing, in FIGS. 1 and 2, a power driven paper take-up mechanism is shown generally at 10. A printer mechanism 12 (shown in outline) is a commercially available double lister printer (EPSON CR-101T manufactured by Shinshu Seiki Co., Ltd. of Japan).

The paper take-up mechanism 10 includes an electric motor 14 having an integral gear reduction mechanism 16. The motor 14 and reduction mechanism 16 are secured to a first bracket assembly 18. An output shaft 20 of the reduction mechanism is coupled to a drive shaft 22. The drive shaft 22 is secured into the first bracket assembly 18 by a pair of snap-in bushings 23 and 24.

A pair of feed rollers 28 and 30 are secured onto the drive shaft 22 by set-screws (not shown). The feed rollers 28 and 30 each have a grooved urethane foam outer surface. A second bracket assembly 32 is secured to the printer mechanism 12. A dividing plate 34 is mounted onto the second bracket assembly 32.

A first spindle assembly 36 and a second spindle assembly 38 are secured to the dividing plate 34. The spindles assemblies 36 and 38 support a pair of paper rolls 37 and 39. A pair of micro switches 40 and 42 are mounted on spindle assemblies 36 and 38 respectively. The microswitches 40 and 42 function as "low paper" sensors.

A pair of tear-off guides 44 and 46 are mounted on opposite sides of the dividing plate 34. The tear-off guides 44 and 46 are made of a polycarbonate and are coated with a static dissipating conductive paint. A pair of entry guides 48 and 50 are positioned below the tear-off guides 44 and 46 respectively, and are secured on opposite sides of the dividing plate 34.

An adhesively backed decal 52 is mounted onto the dividing plate 34 to show the correct path of the paper roll 39. A pair of rewind coils 54 and 56 are mounted onto the first bracket assembly 18. The rewind coils 54 and 56 are molded from a polyacetal such as Delrin® 900 or 8010. A pair of coil braces 55 and 57 are integral to the rewind coils 54 and 56 respectively, and provide resistance against spreading of the coils 54 and 56. The coil braces 55 and 57 also provide a camming surface to prevent a ragged leading edge of paper from inhibiting movement.

A rocker switch 58 is mounted at the top of the first bracket assembly 18. Although not shown, the switch 58 can be electrically connected to the printer 12 to permit rapid advance of either of the paper rolls 37 or 39.

A hinged transparent paper guide 60 is secured to the first bracket assembly 18. The guide 60 aids in routing paper. The guide 60 can be raised to facilitate the routing of a new paper roll. A length of paper 41 (FIG. 3) from the paper roll 39 is routed through the printer 12 and into the paper take-up mechanism 10.

OPERATION

Both sides of the paper take-up mechanism 10 operate identically therefore only one side will be described. Referring to the Figures, especially FIGS. 3 and 3A, the paper 41 travels from the paper roll 39 (not shown in FIG. 3) through the printer 12, between the tear off guide 46 and the entry guide 50. As the paper 41 initially enters the rewind coil 56, there is essentially no contact between the paper and the feed roller 30. As detailed in FIG. 3A, a gap 43 exists between the feed roller and the paper 41. The only resistance which the paper 41 initially encounters is the force exerted by the inner wall of the rewind coil 56.

As shown in FIG. 4, as the paper is wound in the rewind coil 56, the paper 41 begins to act as a spiral spring and thus exerts a negative force which opposes the entry of additional paper 41 into the rewind coil 56. In addition, the increasing friction between the paper and the rewind coil 56 also exerts a negative force which opposes the entry of additional paper. This negative force causes the entering paper to deflect toward the inner wall of the rewind coil 56. The inner wall of the rewind coil 56 is positioned such that as paper 41 is deflected toward the inner wall, the paper 41 comes in contact with the feed roller 30. The feed roller 30 thus exerts a driving force which overcomes the negative force exerted by the paper 41 within the rewind coil. By tailoring the surface of the feed roller 30, the exact shape of the rewind coil 56 and the shape and position of the tear-off guide 46 to the coefficient of friction and the bending resistance of the paper 41, the negative force can be balanced by the driving force exerted by the feed roller 30. If the feed roller 30 exerts a force on the paper 41 which not only exceeds the negative force but also exceeds the resistance from the printer 12, paper 41 will be pulled from the paper roll 39 at an excessive rate.

While the invention has been described with reference to a specific embodiment, it will be understood by those skilled in the art that changes may be made in the form and detail without departing from the scope of the invention.

I claim:

1. A paper take-up mechanism for simultaneously rewinding paper from at least one paper roll comprising:

slip drive means for applying a forward driving force to the paper from each paper roll; and rewind means, into which the paper accumulates, for timely positioning the paper from each paper roll so that upon sufficient paper accumulation, the slip drive means contacts the paper and applies the forward driving force which is proportional to the resistance of the paper to being accumulated in the rewind means.

2. The mechanism of claim 1 wherein said slip drive means comprises:

motor drive means;

a shaft coupled to said motor drive means; and multiple feed roller means mounted on said shaft, operative to exert a force on the paper of each of said rolls.

3. The mechanism of claim 2 wherein said feed roller means comprises:

at least one cylindrical structure, each structure having on its outer radial surface a urethane foam coating which exhibits a frictional force on the paper proportional to the resistance of the paper to being accumulated in the rewind means.

4. The mechanism of claim 1 wherein said rewind means comprises:

a rewind coil having a preselected shape to cooperate with the driven paper of each of said paper rolls to balance the forward driving force of said slip drive means.

5. The mechanism of claim 4 wherein said rewind coil comprises:

a body having a pair of arcuate extensions, with said extensions operative to apply a back pressure onto each paper roll proportional to the amount of paper within each of said extensions.

6. The mechanism of claim 5 wherein said rewind coil further comprises:

a brace extending across the arcuate extensions of said rewind coil.

* * * * *